United States Patent [19]

Bell et al.

[11] 4,382,469

[45] May 10, 1983

[54] METHOD OF IN SITU GASIFICATION

[75] Inventors: Christy W. Bell, Berwyn; Charles H. Titus, Newtown Square; John K. Wittle, Berwyn, all of Pa.

[73] Assignee: Electro-Petroleum, Inc., Wayne, Pa.

[21] Appl. No.: 242,277

[22] Filed: Mar. 10, 1981

[51] Int. Cl.[3] ..... E21B 43/24; E21B 43/26

[52] U.S. Cl. ..... 166/248; 166/302; 166/308

[58] Field of Search ..... 166/248, 271, 302, 308; 48/DIG. 6

[56] References Cited

U.S. PATENT DOCUMENTS

| | | | |
|---|---|---|---|
| 849,524 | 4/1907 | Baker . | |
| 2,795,279 | 6/1957 | Sarapuu | 166/248 |
| 2,818,118 | 12/1957 | Dixon | 166/248 |
| 3,106,244 | 10/1963 | Parker | 166/248 |
| 3,137,347 | 6/1964 | Parker | 166/248 |
| 3,211,220 | 10/1965 | Sarapuu | 166/248 |
| 3,428,125 | 2/1969 | Parker | 166/248 |
| 3,642,066 | 2/1972 | Gill | 166/248 |
| 3,696,866 | 10/1972 | Dryden | 166/248 |
| 3,782,465 | 1/1974 | Bell et al. | 166/248 |
| 3,878,312 | 4/1975 | Berg et al. | 166/248 X |
| 3,946,809 | 3/1976 | Hagedorn | 166/248 |
| 4,013,538 | 3/1977 | Schneider et al. | 166/248 X |
| 4,084,638 | 4/1978 | Whiting | 166/248 |
| 4,228,854 | 10/1980 | Sacuta | 166/248 |

FOREIGN PATENT DOCUMENTS 756582 9/1956 United Kingdom .

OTHER PUBLICATIONS

Coughlin et al, Nature, voi. 279, pp. 301–303 (1979).

Anbah et al, "Application of Electrolinking Phenomenain Civil Engineering and Petroleum Engineering," Annals of the New York Academy of Sciences, vol. 118, Art. 14. Feb. 12, 1965, pp. 585–602.

*Primary Examiner*—Stephen J. Novosad
*Assistant Examiner*—George A. Suchfield
*Attorney, Agent, or Firm*—Patrick J. Hagan

[57] ABSTRACT

Gas is produced in situ from an underground formation of carbonaceous material by passing a controlled direct electrical current through the formation.

15 Claims, 1 Drawing Figure

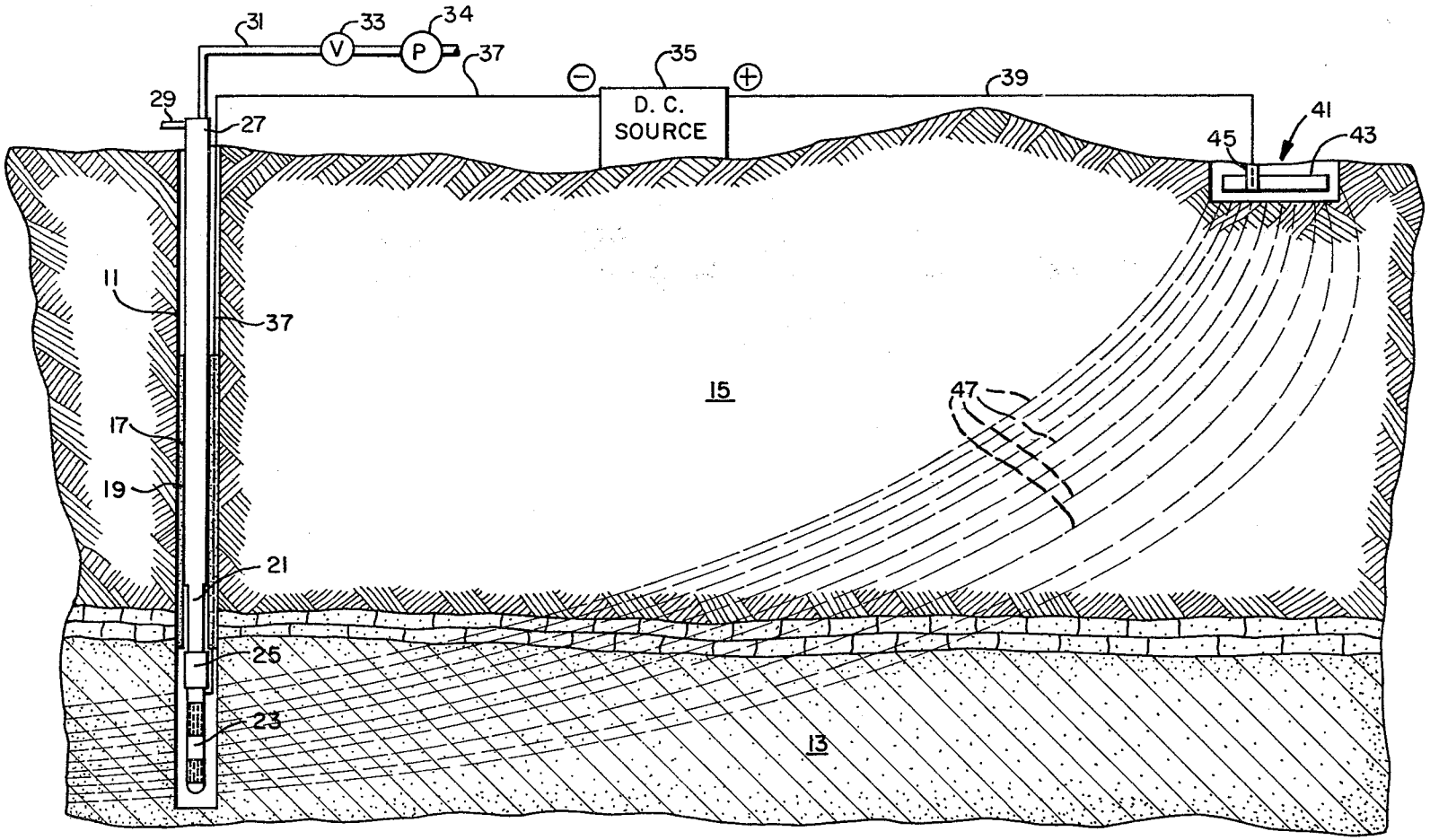
D. C.
SOURCE
P
V
11
13
15
17
19
21
23
25
27
29
31
33
34
35
37
37
39
41
43
45
47

METHOD OF IN SITU GASIFICATION

BACKGROUND OF THE INVENTION

This invention relates to in situ production of gas from an underground formation of carbonaceous material and in particular to a process in which gas production is achieved by applying a direct electric current to the formation.

The production of gaseous and liquid hydrocarbons by in situ gasification of underground formations of carbonaceous substances, such as coal, oil shale, and the like has long been recognized as a means of avoiding the high costs and inefficiencies attendant fuel production by conventional methods which rely on underground mining operations to provide feed stocks.

Among the prior art methods which have been proposed for in situ gas production are those involving combustion of the carbonaceous material in the subterranean formation. In one such method, a combustion zone is established by depositing combustible material in fractures in the formation adjacent to a well-bore, and passing sufficient current between electrodes positioned in well-bores connected with the fractures so as to heat the combustible material to its ignition temperature. Combustion is supported by the injection of oxygen or air through the well-bore into the combustion zone. As the injection of the combination supporting medium continues, the combustion front is driven radially outwardly from the injection well along the fractures. Gaseous hydrocarbons driven out of the formation by the combustion process are recovered from a production well penetrating the formation. See, for example, Dixon, U.S. Pat. No. 2,818,118. Related combustion processes involving electrocarbonization of underground formations to achieve in situ gas production are disclosed in Sarapuu, U.S. Pat. No. 2,795,279 and Parker, U.S. Pat. No. 3,106,244.

Other proposed in situ gasification methods have involved the use of electrical energy to heat the formation directly. For example, Baker, U.S. Pat. No. 849,524, describes a method in which electric current is passed through an underground formation by means of conductors placed in well-bores penetrating the formation, thereby heating the formation and volatizing components thereof, which are recovered through one of the wells. Although the Baker patent does not give the conditions employed in carrying out the method, temperatures in excess of 650° F. are generally necessary to produce fuel gas by pyrolysis of oil shale, tars and coal.

A related method specific to the treatment of oil shale formations is disclosed in Parker, U.S. Pat. No. 3,428,125. The method entails injecting an electrolyte into the formation through two or more well-bores and applying an electrical potential across the formation between the well-bores. An electric current passes through and heats the formation to a temperature sufficient to pyrolyze the hydrocarbons present in the oil shale, while back-pressure is maintained on the formation to prevent vaporization of the electrolyte.

Although the prior art methods referred to above demonstrate that electrical energy can be used successfully for the in situ production of fuel gas, those methods have some rather serious shortcomings.

Combustion processes produce gas which is diluted with combustion products, as well as nitrogen gas in those instances where air is employed to sustain combustion. Dilution occurs as a result of channeling or formation collapse which allows the diluents to breakthrough the combustion front and become intermixed with the gases preceding it. These are natural consequences of combustion processes about which nothing can be done. Hence, while a relatively high Btu content gas is swept in front of the expanding combustion front, the effects of channeling and formation collapse are such that the average Btu value of the gas actually recovered by combustion processes is relatively low, ranging anywhere from 100–1000 Btu/cu.ft. and usually toward the low end of this range.

Electrical methods such as those described in Baker, U.S. Pat. No. 849,524 and Parker, U.S. Pat. No. 3,428,125 require that a temperature on the order of 500° F. to 660° F. be maintained in the underground formation for successful operation. The amount of energy required for heating the formation to within this range is substantial. As stated in the Parker patent, for example, an electrical potential in excess of 400 volts must be impressed across the well casings with sufficient back-pressure of up to 1530 psig. applied on the well-bores to maintain the required temperature in the formation. In view of the ever-increasing costs of electrical energy, the operating conditions of these prior art methods must be considered a severe drawback.

A recent article by Coughlin et al, Nature, Vol. 279, pp 301–03 (1979) reports on an improved electrical method for coal gasification. In this method, a coal slurry undergoes treatment in an electrochemical cell, which is divided into separate anode and cathode compartments, to produce essentially pure hydrogen at the cathode, and $CO_2$, containing small amounts of CO (about 3% at steady-state) at the anode. The method is carried out at relatively moderate temperatures and electrical potentials. For example, lignite reportedly has been gasified at potentials from 0.85 to 1.0 volts at about 240° F. While this method has been practiced on a laboratory scale, its commercial practicability has yet to be demonstrated. Moreover, even if it is operative on a commercial scale, the operating cost thereof would be relatively high, since it would require mined coal for the feed stock. Further, the mixture of gases produced by this method has a lower Btu value than is acceptable for a fuel gas.

The desirability of a commercially practical method for producing a high Btu fuel gas by the use of electrical energy under relatively moderate operating conditions in areas where existing recovery technology has not been effective has lead to the development of the present invention.

SUMMARY OF THE INVENTION

In accordance with the present invention, it has now been discovered that large quantities of high quality Btu fuel gas may be produced in situ under reasonably moderate operating conditions from an underground formation or deposit of carbonaceous material. The gas produced by this method generally has a Btu content of 300 or higher. The method involves providing an aqueous electrolyte in contact with the carbonaceous material placing at least two electrically conductive elements, constituting an anode and a cathode, in contact with the electrolyte, and passing a controlled amount of electric current from a direct current source through the formation between the electrically conductive elements at a voltage of at least 0.3 volts, thereby producing gas by electro-chemical action within the formation and the accompanying gasification of said carbonaceous material. The expression "electro-chemical action" is used herein in a broad sense to signify electrolysis of the electrolyte, changes in the characteristics of the carbonaceous material by the passage of direct electrical current therethrough, and/or oxidation of the carbonaceous material.

The operating electrical current should be selected so as to maintain a temperature of less than 500° F. within the formation at the surface of the electrodes. Generally, this may be accomplished by connecting the electrodes to a controlled direct current source.

From this brief description, it will be appreciated that the present invention provides a process for the production of a high Btu content fuel gas which obviates underground mining or production operations.

In addition, the present invention provides a process for the in situ production of fuel gas from an underground formation, which gas is of a substantially higher quality than that produced by a process involving combustion in the formation.

The present invention further provides an electrical process for the in situ production of a fuel gas under relatively moderate temperatures and electrical power input.

The present invention also provides a process for the in situ production of a high Btu content gas on a commercial scale.

DESCRIPTION OF THE INVENTION

The present invention will be fully understood from a reading of the following detailed description thereof, in conjunction with the accompanying drawing in which the sole FIGURE is a cross-sectional view through an underground formation or deposit of carbonaceous material penetrated by a single well-bore, with apparatus for the practice of the present method shown schematically therein.

Referring more specifically to the drawing, there is shown a well-bore 11 which extends from the earth's surface and penetrates a subterranean formation of carbonaceous material 13 lying beneath overburden 15. The subterranean formations from which gas may be produced in accordance with this invention include deposits of heavy oil, coal, or oil shale.

The well-bore 11 is provided with a pressure resistant casing 17 which desirably extends from the surface at least to the top of the formation, and which may be cemented in the well-bore as indicated by reference numeral 19. The well casing may be fabricated of electrically insulating or electrically conductive material. The electrically conductive casing may be wrapped with insulation tape or other similar material to provide an insulating layer or sheath on the outside thereof, or may be articulated by one or more insulated segments. The lower end of the casing may be provided with a horizontally disposed annular plate or sealing diaphragm (not shown).

The well is also provided with a hollow, metal well liner 21, which is hung from the well casing and extends to any desired depth in the well bore 11. Attached to the bottom end of the well liner is an electrically conductive element 23, which serves as a "down hole" electrode. Conductive element 23 may be metallic or nonmetallic so long as it possesses low electrical resistivity and exhibits sufficient mechanical strength, thermal stability and resistance to corrosion to prevent breakdown during normal operation of the process. The electrically conductive element is electrically isolated from the well liner by an insulating sleeve 25. A section of fiber glass pipe or equivalent provides a satisfactory insulating sleeve. Insulating electrically conductive element 23 from well liner 21 in this way protects against arcing or short circuits therebetween. As a further precaution against arcing or short circuits, well liner 21 may be fabricated from or surrounded with suitable electrically insulating material. Electrically conductive element 23 may have perforations on the external surface thereof, as shown in the drawing, and/or the lower end thereof may be open for the injection of fluids into, or the withdrawal of fluids from the well-bore. In this connection, the well head 27 is provided with an input flow line 29 for the delivery of fluids to the well bore. Thus, fluids may be injected into the well under pressure through flow line 29 and discharged through the opening(s) in electrically conductive element 23 whereupon they seep into the surrounding formation between the bottom of the casing and the bottom of the well-bore. Gas produced in the formation is extracted through flow line 31, which may have a control valve 33 and conventional pumping means 34 connected therewith.

At ground level, one terminal of a direct current source, shown schematically as 35, is connected to electrically conductive element 23 via cable 37. The other terminal of direct current source 35 is connected via cable 39 to electrode 41 located at or near the earth's surface. The direct current source may be powered from the A.C. power system normally used to operate conventional oil pumping equipment. As illustrated in the drawing, the negative terminal of the direct current source is connected to the "down hole" electrode, making it the cathode, and the positive terminal of the direct source is connected to the surface level electrode, making it the anode. Although the drawing shows one "down hole" electrode and one surface level electrode, the process will operate satisfactorily with two or more "down hole" electrodes. The surface level electrode simplifies operation of the process by obviating the digging of a second well bore.

The direct current source should be provided with a current regulator (not shown) for controlling the current applied to the electrodes. Suitable transformers, switches, meters, or other electrical instruments (not shown) may also be employed for regulating the direct current supply and the electrical treatment of the formation so as to optimize gas production. Other instruments, well known to those skilled in the art may be employed for monitoring conditions in the formation, analyzing the gaseous product, or otherwise providing desired information concerning the operation of the process.

Satisfactory results have been obtained using a surface level electrode comprising a plurality of electrically conductive pipes 43 (only one shown in drawing) arranged parallel to one another in a horizontal plane in a containment means in the earth's surface. Each electrically conductive pipe of the surface level electrode is attached to an electrical contact 45 which is connected in turn to direct current source 35. Other forms of surface level electrodes such as those described in Sarapuu, U.S. Pat. No. 3,211,220 may be used in the practice of this invention.

A current path, represented in the drawing by dashed lines 47, is established between the two electrodes described above by providing an aqueous electrolyte in contact with the formation. In most instances, connate water within an underground formation of carbonaceous material will contain various dissolved salts, thereby providing a natural aqueous electrolyte solution. Where the formation tends to be dry, as in the case of oil shale, for example, a suitable electrolyte solution must be injected from above ground through the well liner and into the formation. Where necessary, an electrolyte solution may be injected into the earth in the vicinity of the surface level electrode.

The embodiment of this invention illustrated in the drawing and described in the preceding paragraphs establishes an electrical circuit for current flow, which travels from direct current source 35, through cable 39, passing through the formation between surface level electrode 41, and "down hole" electrode 23 via the electrolyte, and back to the direct current source through cable 37. As previously mentioned, the possibility of short circuits or arcs between the "down hole" electrode 23 and the well casing 17 or well liner 21 may be minimized by surrounding a portion of the well liner, as well as a portion of the casing itself, with electrically insulating material.

For maximum operating efficiency, the "down hole" electrode should be shorter than the thickness of the formation undergoing treatment. This tends to confine the current flow to a reasonably narrow band within the formation, heating the formation rather than the overburden or underburden. The thickness, as well as other characteristics of the formation may be determined rather accurately by methods well known to those skilled in the art, such as electric logging, core sampling, and the like.

In order to optimize gas production in formations having low gas permeability and diffusivity, the formation may be provided with passageways prior to commencing electrical treatment, so that the gas is permitted to permeate through the formation and reach the well-bore through which it is withdrawn from the formation. This may be achieved by conventional fracturing techniques. Other procedures for rendering the formation permeable to fluid flow, which are well known to those skilled in the art, may also be employed if the formation is not sufficiently permeable.

Under normal operating conditions, the temperature rise around the "down hole" electrode is generally higher than in the formation because the current and voltage densities are concentrated in this vicinity. Accordingly, this region may be kept cool by introducing a liquid coolant into the well-bore. The liquid coolant may be continually recirculated by pumping it back to the surface after injection into the well-bore. Alternatively, the liquid coolant may be injected through openings in the "down hole" electrode into the formation, to simultaneously cool the electrode and carry heat into the formation. In both of these procedures the back pressure imposed on the well-bore controls the boiling point of the electrolyte and prevents large heat losses during operation of the process. These cooling procedures have been employed in maintaining the temperature at the surface of the "down hole" electrode below 275° F. for up to 5440 hours of operation of the process.

The preferred liquid coolant for use in connection with this invention is water. Although other liquid coolants are available, including a variety of hydrocarbon liquids, water is preferable to such other coolants from the standpoint of cost and availability. When the coolant liquid is injected into the formation, brine may be used, in whole or in part. In addition to cooling the "down hole" electrode, brine will replenish electrolyte which may have been lost through evaporation.

High quality gas was produced using the above described process, in tests conducted in a heavy oil (tar sand) formation in the Brooks Zone near Santa Maria, Calif. The Btu content of the gas produced was consistently in excess of 1000, and was calculated to be approximately 150% of the input energy. This represents about a 44.5% increase over the Btu content of the gas naturally occurring in the formation. The average temperature at the "down hole" electrode surface during operation of the process was 255° F. The two electrodes were spaced approximately 3000 feet apart. Gas samples were taken for analysis by gas chromatography and were found to consist essentially of hydrogen, hydrocarbons from 1 to 8 carbon atoms and carbon monoxide, which is a readily combustible mixture.

Although the electrochemical mechanism by which gas is produced by the above-described method is not completely understood, it is believed to result from the combined action of electrolysis of the electrolyte and gasification of the carbonaceous material in the formation, as previously mentioned. Electro-chemical action within the formation produces hydrogen along with carbon monoxide; gasification produces the $C_1$ to $C_8$ hydrocarbon gases.

The amount of hydrogen produced by this process has been calculated as being in excess of that which would be anticipated assuming that water in the formation undergoes electrolysis at 100% efficiency at the cathode. Thus if all of the electrical input to the formation during this period were used at 100% efficiency in the production of hydrogen by electrolysis, the theoretical amount of hydrogen produced should have been only 45% of the amount of hydrogen actually recovered.

The excess hydrogen gas produced may be explained at least in part, as resulting from the occurrence of electrolysis out in the formation. It is thought that electrolysis occurs at other anodic and cathodic sites, such as at the end of shale stringers or other discontinuities in the formation where sufficient electrical energy is available. An indication that electrolysis is taking place out in the formation is provided by the relatively slow build-up of hydrogen when a D.C. current is caused to flow through the formation, and the continued production of hydrogen when the D.C. power is interrupted. The production of hydrogen at a multiplicity of sites throughout the formation is possible only as a result of conditions created by the passage of direct electrical current through the formation.

It is also conceivable that a hydrocarbon cracking mechanism may contribute to the production of hydrogen in this process.

In contrast to the gas recovered prior to the testing period, the $C_2$ to $C_6$ fraction of the gas produced during the testing period increased by 500% to 600%; however, the methane content decreased by about 50%. This increase in the $C_2$ to $C_6$ fraction is primarily responsible for the high quality of the gas produced by the process of this invention. Thus, whatever, the mechanism at work, it produces an unexpected increase in the hydrocarbon component of the recovered gas.

The carbon dioxide content of the gas produced during the test period was generally lower than that of the gas naturally occuring in the formation prior to the test period. During periods when the DC power was interrupted, the $CO_2$ content was about 50% of the original amount, whereas during application of D.C. power, the carbon dioxide content decreased to 25% of the original amount. The reduction in carbon dioxide content is attributed to the increase in pH of the electrolyte from 7 or 8 to 10 or higher during application of power.

Although there is some suggestion of the use of direct current potential for in situ gasification in the prior art, the practitioners of the prior art methods apparently did not appreciate the distinct advantages attendant the use of a controlled direct current, both as to the increase in the quality of gas produced, and the reduction in the cost of operating the process by reason of the comparatively lower temperature and electrical potentials which may be employed. Application of a direct current through the formation has other advantages over the use of an alternating current potential. For example, when alternating current is passed down a well-bore having a steel casing by means of a cable or insulated tubing string, the well casing behaves like a very inefficient transformer core, wasting most of the electrical energy by heating the casing and the overburden rather than the formation. In addition to being more efficient, the use of a direct current source may require only 5% to 10% of the voltage that an alternating current source would require in order to pass the same magnitude of current into a formation. This improves safety and reduces the difficulty and expense involved in providing down hole electrical insulation.

The preference for alternating current systems over direct current systems in the prior art may have been due to concern over electrolytic corrosion of the piping employed, particularly the anode. Such concern is unwarranted, however, for experience with the present process has demonstrated that corrosion of the anode can be easily controlled by using an anode design of the type described above. Alternatively, corrosion resistant materials, such as lead dioxide or graphite may be used in fashioning the anode. Corrosion of the cathode simply does not occur to an appreciable degree in the practice of this invention.

The use of a controlled current source is preferable to a constant voltage source since the latter is potentially unstable and may cause "runaway" temperatures at the well-bore in situations where, as in the practice of this invention, the resistance of the formation decreases with increasing temperature. Indeed, in the present invention, the decrease in formation resistivity with increasing temperature acts as a temperature regulator in the vicinity of the well-bore and further aids in moving the heat further out into the formation.

As previously mentioned, the process of this invention may be employed successfully in producing fuel gas from heavy oil, oil shale or coal formations. The expression "heavy oil" as used herein is intended to encompass deposits of carbonaceous material which are generally regarded as exhausted because treatment by presently available recovery processses are uneconomical or impractical. These include, for example, tar sands, and oil residues in wells that have been depleted by primary, secondary and tertiary recovery processes. In the case of coal formations, this process is particularly suited for the recovery of gas from coal located at depths too great for conventional mining operations, or from deposits of inferior value.

Although a specific well completion procedure is described above, it should be understood that other completion procedures well known to those skilled in the art and consistent with the practice of this invention may also be employed.

It should be understood that the description of this invention set forth in the foregoing specification is intended merely to illustrate and not to limit the invention. Those skilled in the art will appreciate that the implementation of the above-described process is capable of wide variation and modification without departing from the spirit and scope of the invention as set forth in the appended claims.

We claim:

1. A process for producing gas from an underground formation of carbonaceous material said gas having a BTU content of 300 or higher, which method comprises providing an aqueous electrolyte in contact with said formation, providing at least two electrically conductive elements, constituting an anode and a cathode, in contact with said electrolyte, passing a controlled amount of electrical current from a direct current source through said formation between said electrically conductive elements at a voltage of at least 0.3 volts and controlling the current relative to the composition of said material and the ambient conditions adjacent to said electrode to heat the surface of the electrodes during application of said voltage to a temperature which is less than 500° F. thereby to produce gas by electrochemical action within said formation and the accompanying gasification of said carbonaceous material.

2. The process of claim 1 wherein one of said electrically conductive elements is provided adjacent said earth's surface.

3. The process of claim 2 wherein the electrically conductive element provided adjacent earth's surface serves as the anode.

4. The process of claim 1 wherein at least one of said electrically conductive elements is provided by drilling a well which penetrates said formation and inserting in the well bore an elongated liner having an upper portion and an electrically conductive lower portion, said upper portion being electrically insulated from said lower portion, which latter portion is connected to said direct current source.

5. The process of claim 4 wherein said lower portion of said liner serves as the cathode.

6. The process of claim 4 wherein the formation has a given thickness and said lower portion of said liner is disposed within the boundary of said formation and is shorter than the thickness of said formation.

7. The process of claim 4 which includes cooling the formation around the electrically conductive lower portion of said liner by introducing a liquid coolant into the well-bore.

8. The process of claim 7 wherein the electrically conductive lower portion of said liner is perforated and said liquid coolant is injected into said formation through said lower portion.

9. The process of claims 7 or 8 wherein said liquid coolant is water.

10. The process of claim 1 wherein the formation is provided with passageways before said electrical current is passed therethrough said passageways permitting the gas produced to permeate through said formation.

11. The process of claim 10 wherein said passageways are provided by fracturing said formation.

12. The process of claim 1 wherein said carbonaceous material is selected from the group of heavy oil, oil shale, or coal.

13. The process of claim 1 wherein the gas produced is a combustible gas consisting essentially of hydrogen, hydrocarbons having from 1 to 8 carbon atoms, and carbon monoxide.

14. The process of claim 1 wherein the formation of carbonaceous material is a sand formation and the gas produced has a Btu content of 1000 or higher.

15. A process for yielding a gas from a subsurface formation of hydrocarbon material by treatment with direct electrical current, which process comprises providing an aqueous electrolyte in contact with said subsurface formation, providing at least two electrically conductive elements, constituting an anode and cathode, in contact with said electrolyte, passing a controlled amount of electrical current from a direct current source through said formation between said electrically conductive elements at a voltage of at least 0.3 volts and controlling the current relative to the composition of said material and the ambient conditions adjacent to said electrode to heat the the electrodes during application of said voltage to a temperature which is less than 500° F. and, and withdrawing from said formation the gas resulting from said treatment.

* * * * *